US007546663B2

(12) United States Patent
Duffy

(10) Patent No.: US 7,546,663 B2
(45) Date of Patent: Jun. 16, 2009

(54) HOOD HINGE WITH COIL SPRING

(75) Inventor: Michael J. Duffy, Midland (CA)

(73) Assignee: M & C Corporation, Sterling Heights, MI (US)

( * ) Notice: Subject to any disclaimer, the term of this patent is extended or adjusted under 35 U.S.C. 154(b) by 244 days.

(21) Appl. No.: 11/549,295

(22) Filed: Oct. 13, 2006

(65) Prior Publication Data

US 2008/0098567 A1 May 1, 2008

(51) Int. Cl.
*E05F 1/08* (2006.01)

(52) U.S. Cl. ..... 16/306; 16/296; 16/298; 296/76; 296/146.11

(58) Field of Classification Search ..... 16/306, 16/289, 290, 296, 298, 295, 308; 296/76, 296/146.11; 49/386
See application file for complete search history.

(56) References Cited

U.S. PATENT DOCUMENTS

| | | | | | |
|---|---|---|---|---|---|
| 2,124,893 | A | * | 7/1938 | Peppas | 297/333 |
| 2,272,230 | A | | 2/1942 | Voorhees | |
| 2,308,759 | A | | 1/1943 | Joachim | |
| 2,547,550 | A | * | 4/1951 | Whitmore | 16/298 |
| 2,612,651 | A | * | 10/1952 | Roethel | 16/295 |
| 2,626,421 | A | * | 1/1953 | Lyons | 16/300 |
| 2,703,430 | A | | 3/1955 | Thomas et al. | |
| 3,024,488 | A | * | 3/1962 | Germann | 16/306 |
| 3,304,117 | A | | 2/1967 | Harris et al. | |
| 3,810,275 | A | * | 5/1974 | Smith | 16/298 |
| 3,937,489 | A | * | 2/1976 | Hawes et al. | 280/204 |
| 4,580,315 | A | * | 4/1986 | Beckwith | 16/308 |
| 5,235,725 | A | | 8/1993 | Rees | |
| 5,243,738 | A | | 9/1993 | Kiefer | |
| 5,465,862 | A | * | 11/1995 | Devlin | 220/830 |
| 5,967,586 | A | * | 10/1999 | Duffy et al. | 296/76 |
| 6,618,904 | B1 | * | 9/2003 | Nagy | 16/370 |
| 6,779,234 | B1 | * | 8/2004 | Lu et al. | 16/340 |
| 6,867,962 | B2 | * | 3/2005 | Cho et al. | 361/681 |
| 6,929,279 | B2 | | 8/2005 | Boden | |
| 7,350,845 | B1 | * | 4/2008 | Duffy | 296/76 |
| 2005/0172453 | A1 | * | 8/2005 | Duffy | 16/307 |
| 2006/0225247 | A1 | * | 10/2006 | Duffy | 16/307 |
| 2006/0230578 | A1 | * | 10/2006 | Renke et al. | 16/289 |

OTHER PUBLICATIONS

International Search Report dated Sep. 2, 2008.

* cited by examiner

*Primary Examiner*—William L. Miller
(74) *Attorney, Agent, or Firm*—Brooks Kushman P.C.

(57) ABSTRACT

A vehicle body hinge mechanism includes at least one hinge set carried by a support plate that retains a pivot pin and a retainer bar in a cantilevered manner. Preferably, the plate is stamped, and the pivot pin supports a lever, such as a goose-neck arm, that will be coupled to the hood. The plate includes a mount that will be carried by peripheral body structure around the hood opening. The retainer bar carries a helically wound spring that secures one end of the spring for resistance to rotation about the axis of the bar. The other end of the spring engages a linkage that urges the lever to pivot toward the open position. Preferably, a stop limit is integrally incorporated in the linkage carried by the plate to stop the lever at a desired hood opening limit.

18 Claims, 5 Drawing Sheets

HOOD HINGE WITH COIL SPRING

BACKGROUND OF THE INVENTION

1. Field of the Invention

A motor vehicle body hood is supported by a hinge set in which a support plate with a mount carries a spring retainer and a pivot pin in cantilevered protrusion for packaging the pivot associated linkage and biasing spring in an easily mounted, compact package.

2. Background Art

Previously known types of hinge systems include a pair of pivoted components attaching the deck lid to the body. These hinges provide a single, fixed pivot axis for the hood, with a prop rod anchored on the front reinforcement of the hood compartment that swivels to hold the hood in an open position. Other mechanisms include a 4bar linkage with gas strut, and in older vehicles, a 4bar or 6bar linkage with either a clock spring or an extension spring. However, the user must manipulate the prop rod separately from the lifting action of the deck lid, and such activity can be difficult in the dark when the prop rod must be aligned with a receptacle such as a body opening to prevent inadvertent displacement of the prop rod and closing of the hood.

The difficulties of utilizing and storing a prop rod has been alleviated where gas struts apply force to the hood to urge it to its open position. However, struts with fluid pressure may be quite costly and may perform inconsistently as ambient or operating temperatures fluctuate. Moreover, the forces of compressed fluids may have to be specifically selected or built and designed to fit or work with the hoods included in each of various body styles and designs of a motor vehicle. Moreover, the position of such struts obstructs access to the compartment covered by the hood from the sides of the open hood and may have reduced durability compared to completely mechanical systems.

Another way to provide the advantages of self-supporting open hoods has been a multilink hinge structure which is large and complex and requires loading of the spring during in-plant assembly. Accordingly, multiple steps must be performed during installation in the production process for these previously known systems.

SUMMARY OF THE INVENTION

The present invention overcomes the above mentioned disadvantages by providing a hold-open hood mechanism permitting installation of the hinge and the power source into the vehicle body in one step without prewinding a spring. The hinge set installation does not require the use of gas struts that obstruct access to the hood opening, and does not add substantial bulk to the package of the hinge set or obstruct the area within the compartment covered by the hood. The method and apparatus embodiments rely upon a support plate with a mount securable to peripheral vehicle body structure. A pivot pin is carried cantilevered by the support plate. A retainer bar is also carried cantilevered by said support plate. A spring with a helically coiled strand is received on the retainer bar and an end of the helically coiled strand biases a lever pivoted on the pivot pin toward the open position.

Preferably, a linkage mechanism applies a mechanical advantage to the lever preferably by pivotally connecting a link to the lever, and pivotally engaging the strand end in the link. As a result, embodiments of the method and the apparatus hold the hood open without separate manipulations, but allowing simplified assembly into the vehicle. Installation of the hinge and the power source for each hinge set may be performed in one step. Obstructions provided by previously known prop rods, pre-wound springs or gas struts may be eliminated.

BRIEF DESCRIPTION OF THE DRAWINGS

The present invention will be more clearly understood by reference to the following detailed description of a preferred embodiment when read in conjunction with the accompanying drawing, in which like reference characters refer to like parts throughout the views, and in which.

DETAILED DESCRIPTION OF THE PREFERRED EMBODIMENT(S)

Figure 1:
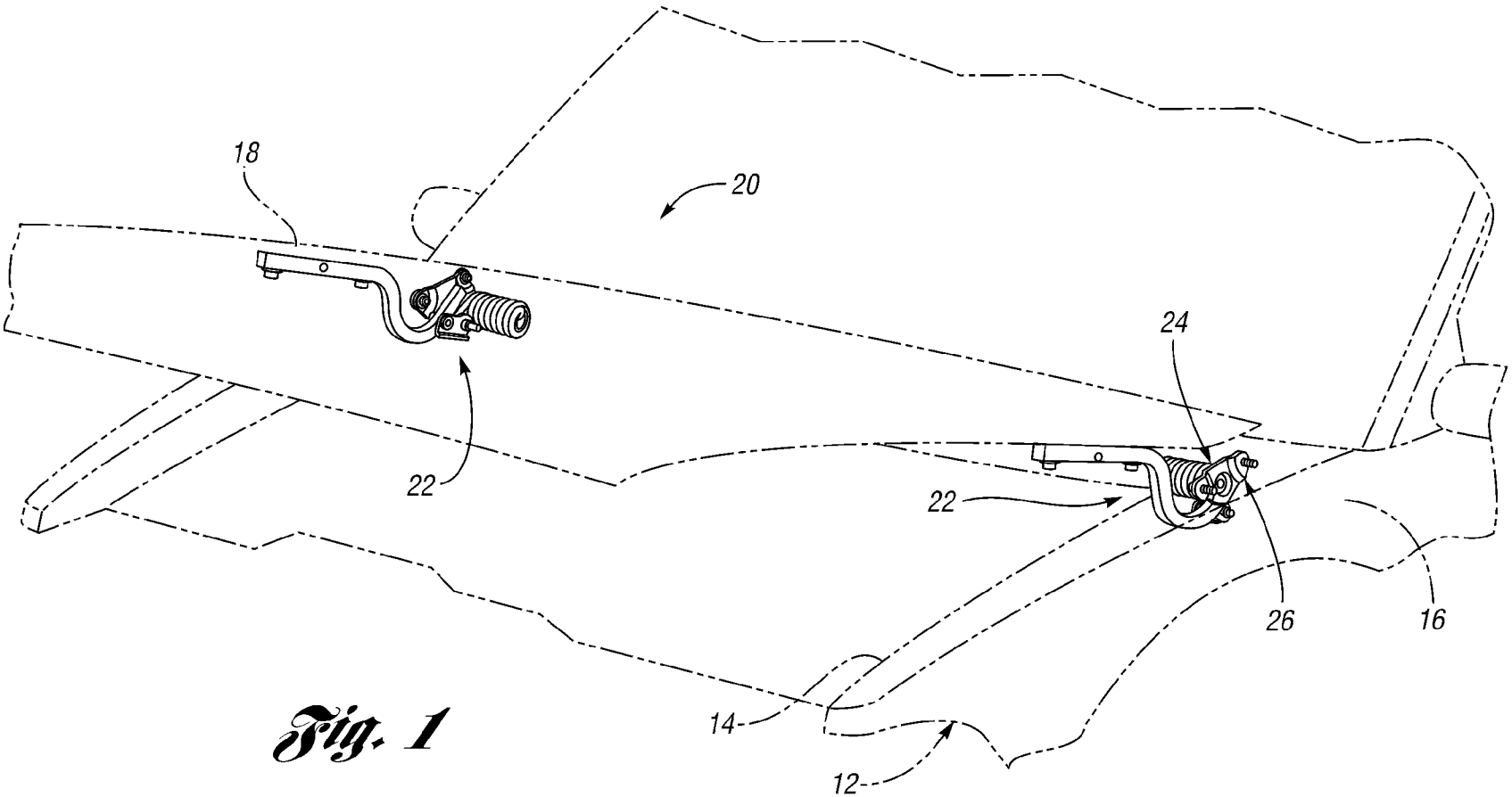
FIG. 1 is a perspective view of a vehicle hood portion of a motor vehicle body including a preferred embodiment of a hinge with a pair of hinge sets according to the present invention.

Referring first to FIG. 1, a motor vehicle body 12 is there shown including hood compartment 14 defined by a peripheral body structure 16. A hood 18, preferably styled together with the peripheral body structure 16, covers the opening of the hood compartment 14 in a closed position. The hood 18 is mounted by a hinge mechanism 20. The hinge mechanism 20 preferably comprises a pair of hinge sets 22, that may be constructed as discussed in greater detail below. While a pair of hinge sets 22 is preferred to balance the application of force from lateral portions of the hood, so that displacement forces are balanced about the pivot axis, variation in number or types of hinge sets that may be employed to form the hinge depend upon the design and styling of the motor vehicle or the type of hood being used to cover a compartment in a vehicle body. For example, the left hinge set 22 of the pair is preferably a mirror image configuration of the right hinge set 22 in the preferred embodiment, but may also be different without departing from the present invention.

In the preferred embodiment, each hinge set 22 includes a support plate 24 (FIG. 2) having a mount 26 (FIG. 1) for securing the hinge set to the peripheral body structure 16. In the preferred embodiment, the mount 26 comprises separated lands 28 and 30 (FIG. 2) formed, for example, by stamping the plate 24, to mate with surface portions of the peripheral body structure 16. The lands 28 and 30 include openings adapted to receive fasteners such as bolts that are received through aligned openings in the plate 24 and mating portions of the peripheral body structure 16.

In addition, the plate 24 carries a pivot pin 32 in a cantilevered protrusion from one surface of the plate 24. Similarly, the plate 24 carries a retainer bar 34 cantilevered to extend outwardly from the surface of the plate on the same side as the pivot pin 32. Preferably, the pivot pin 32 and the retainer bar 34 are positioned at spaced apart positions and extend parallel to each other from a face of a plate 24 when the biasing is to be exerted from a position offset from the pivot axis.

Figure 3:
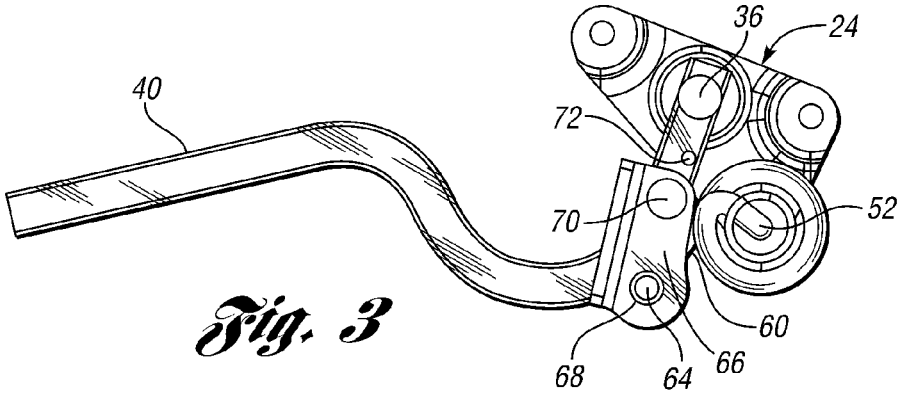
FIG. 3 is an enlarged elevational view showing the hinge set of FIG. 2 in the closed position.

A pivot pin 32 may include an enlarged head 36 (FIG. 3) and a shank 38 (FIG. 6) extending through the aligned openings in a lever arm 40. The shank may be retained in a bushing 41 (FIG. 6) carried in appropriately sized openings of the lever 40 to permit the lever to pivot about the axis of a pivot pin 32. The shank 38 of a pivot pin 32 may terminate in a shoulder 42 (FIG. 6), from which the terminal end portion 44 of the shank extends through a reduced diameter opening in the plate 24. The shoulder 42 engages the surface of the plate and the protruding portion of the end 44 (FIG. 4) may then be peened, as shown at 47 in FIG. 4, against the opposite side or surface of the plate 24. Nevertheless, structural changes may be employed in the pivot pin without departing from the invention.

Figure 6:
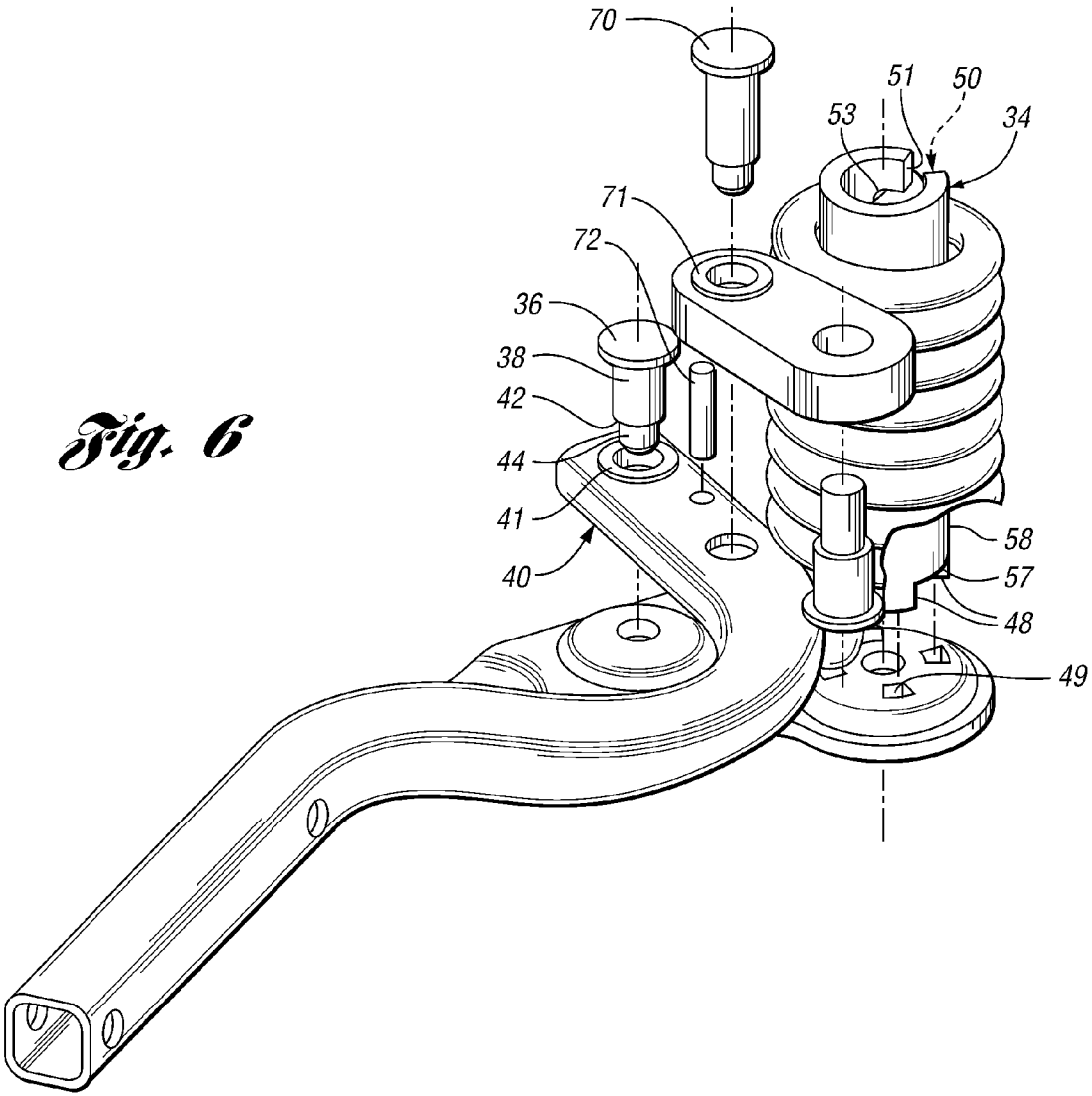
FIG. 6 is an enlarged, exploded perspective view of portions of the hinge set shown in FIGS. 1-4.

Similarly, the retainer bar 34 may include a shoulder 57 (FIG. 6) that rests against the surface of the plate 24. The tube forming the retainer bar 34 in the illustrated embodiment shown includes an end portion 58 (FIG. 6) including one or more projections 48 that extend through one or more apertures 49 in the plate 24. Preferably, each projection 48 may be peened against the opposite side surface of the plate 24. For example, the end protrusion 48 may have a flat, polygonally shaped or other cross-sectional configuration, matching the periphery of the opening 49, to resist rotation about the retainer bar's axis with respect to the plate, particularly if only one axial end protrusion 48 is used. As shown in FIG. 6, multiple protrusions 48 and openings 49 may be employed and their arrangement may be modified as desired. Other structural changes to the retainer bar 34 may be made without departing from the invention.

Figure 4:
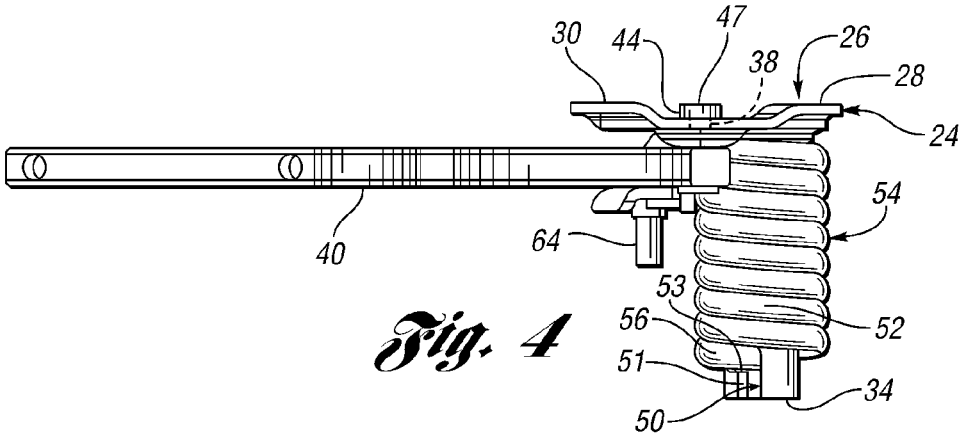
FIG. 4 is an enlarged plan view of the hinge set shown in FIG. 3.

The retainer bar 34 includes a recess 50 (FIG. 4) in the form of a longitudinal slot 51 communicating with a circumferentially offset bayonet cavity 53 in a wall of a tubular retaining bar 34. The recess 50 receives a terminal end portion 56 of a spring strand 52 (FIG. 4). The strand 52 is helically coiled and the coiled portion 54 (FIG. 4) is received over the retainer bar 34. The recess 50 may be formed in alternative configurations, such as in the form of bores diametrically formed in the bar 34. However, an open ended recess 50 formed by opposing slots may be employed for simplicity of assembly, as a strand end 56 (FIG. 4) may easily be received for fixed relative rotation with the retainer bar 34 so as to lock the helically coiled spring to the retainer bar. Other structures may be employed for securing the strand end to the retainer bar without departing from the invention.

Figure 2:
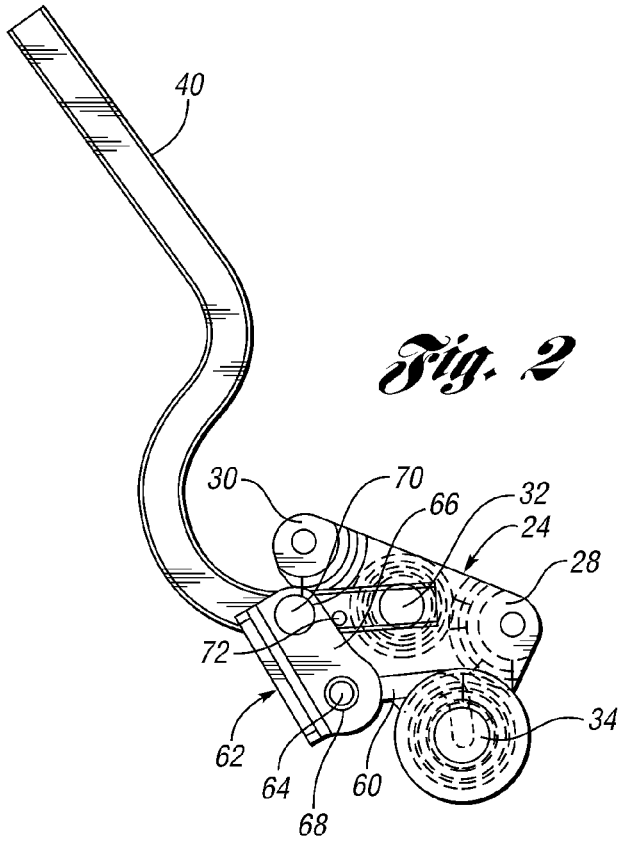
FIG. 2 is an enlarged elevational view of a hinge set shown in FIG. 1 and showing the hood in the open position.

A strand portion 60 (FIG. 2) extends from the other end of the coil portion 54 (FIG. 4) of the helically coiled spring. The strand end 60 is preferably pivotally coupled to the link 62 (FIG. 2). In a preferred embodiment, the strand end includes an arm 64 (FIGS. 2-4) formed by bending the strand. The arm 64 extends substantially parallel to the axis of the coiled portion 54 surrounding the retainer bar 34 although the arm may be aligned off the exact alignment to account for deflections that may occur during operation of the hinge. The arm 64 may be carried in a bushing 68 (FIG. 6) or the like received in an opening extending through the link wall 66 (FIG. 2). The link wall 66 also includes another aperture spaced from the bushing opening that receives a pivot pin 70, that may be similarly mounted by a bushing 71 or the like. The pin 70 extends into the lever 40, at a position spaced from the pivot axis of the pivot pin 32, preferably, through bushings or the like that may be installed or fixed to the lever to pivotally retain the link 62 with respect to the lever 40 by the pin 70. Structural changes to these parts may be made without departing from the invention.

In a preferred embodiment, the lever 40 comprises a tubular member having walls that retain the bushings carrying the pivot pin 70 pivotally connecting the link 62 with the lever 40. Preferably, the lever 40 has a gooseneck shape, often referred to as a gooseneck strap, to avoid interference between the hood 18 and the peripheral body structure 16 in the displacement path between the open and closed positions of the hood 18.

In addition, each hinge set mechanism preferably includes a stop means for limiting displacement of the gooseneck bar toward the open position. The stop may also be arranged separate from the hinge set, for example, as part of the peripheral body structure 16, without departing from the invention. In addition, components other than hinge set parts may be used to engage the gooseneck bar, the hood 18, or other components of the hinge mechanism in order to limit the displacement of the hood at an open position. In the embodiment of FIGS. 1-4 and 6, the tubular lever 40 carries a limit stop 72 (FIG. 4) in the form of a pin 74 (FIGS. 2, 3, and 6) extending in a direction away from interference with the face of the plate 24. The pin 74 may be press fit in an opening as shown in FIG. 6 or otherwise joined to the lever 40. As best shown in FIG. 2, the limit stop pin 74 interferes with the displacement of the edge of the link wall 66 as the lever 40 is displaced toward the open position and resists displacement of the lever 40, and thus the hood 18, beyond the position determined by the abutment of the wall 66 edge and the limit stop 72 integrally with the hinge set. Other structures may also be used to form limit stop 72 integral with or apart from the hinge set 22.

Figure 5:
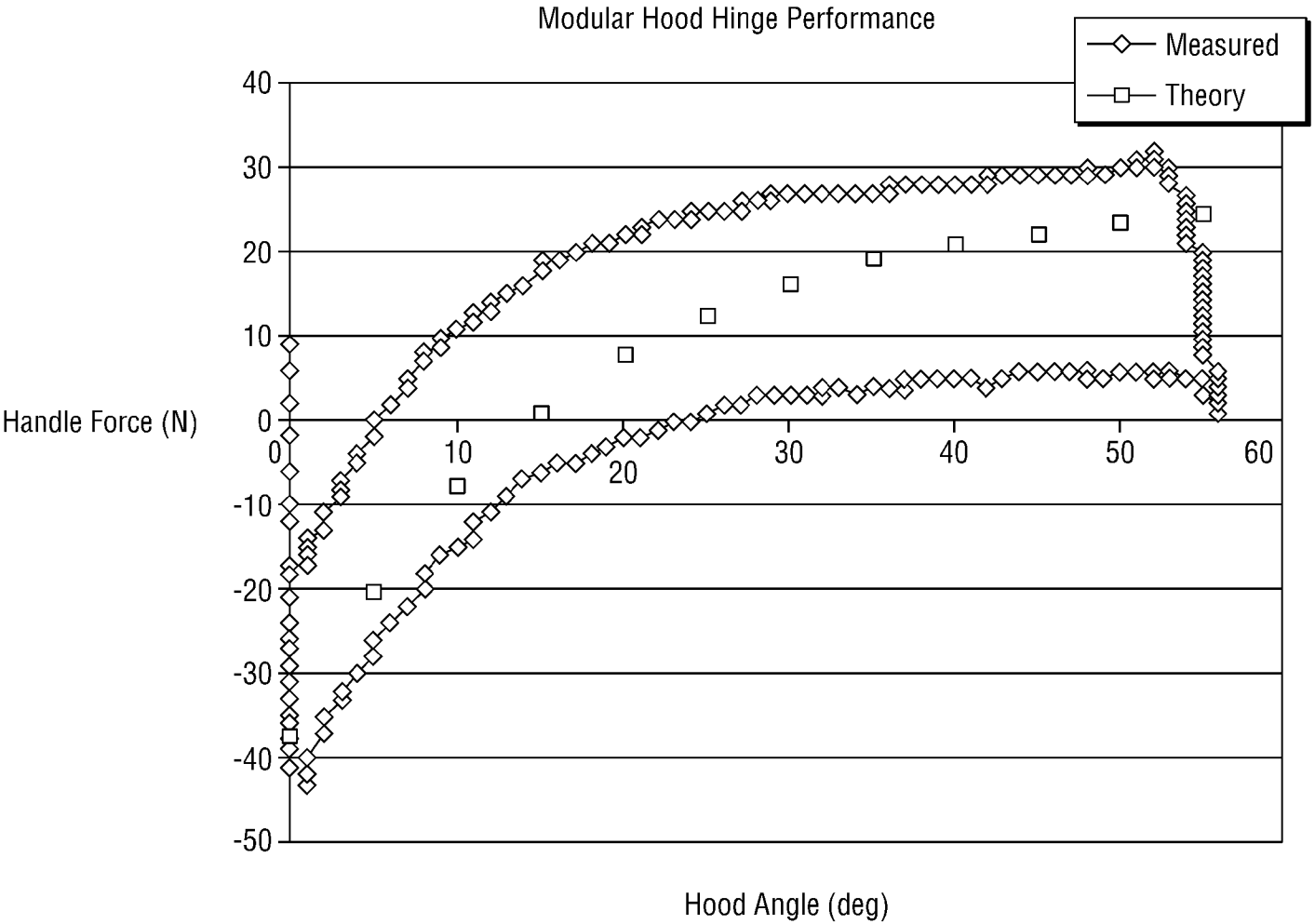
FIG. 5 is a graphical representation of forces exerted by the hood when displaced along the opening/closing path.

Preferably, the coiled spring 54 applies torque to the strap through a carefully designed link such that the link and the coil spring force create maximum mechanical advantage when the hood 18 is in an open position. Generally, the open position of many vehicle hoods would orient a helically wound coil spring and linkage combination to create approximately a 140° angle between the link longitudinal axis and the coil to link connection position about the coil axis with respect to the closed position alignment. Such a limit upon design displacement is desired to permit parts to be constructed with standard tolerances and looseness to avoid reaching 180° of movement or overtoggling. Moreover, this limit avoids a steep output curve in FIG. 5. Between the open and closed positions, the spring force is exerted without needing additional energy exerting structure such as struts or prop rods. The present invention does not require, but does not preclude, using these prop rods for additional locking of the open position if desired.

Figure 7:
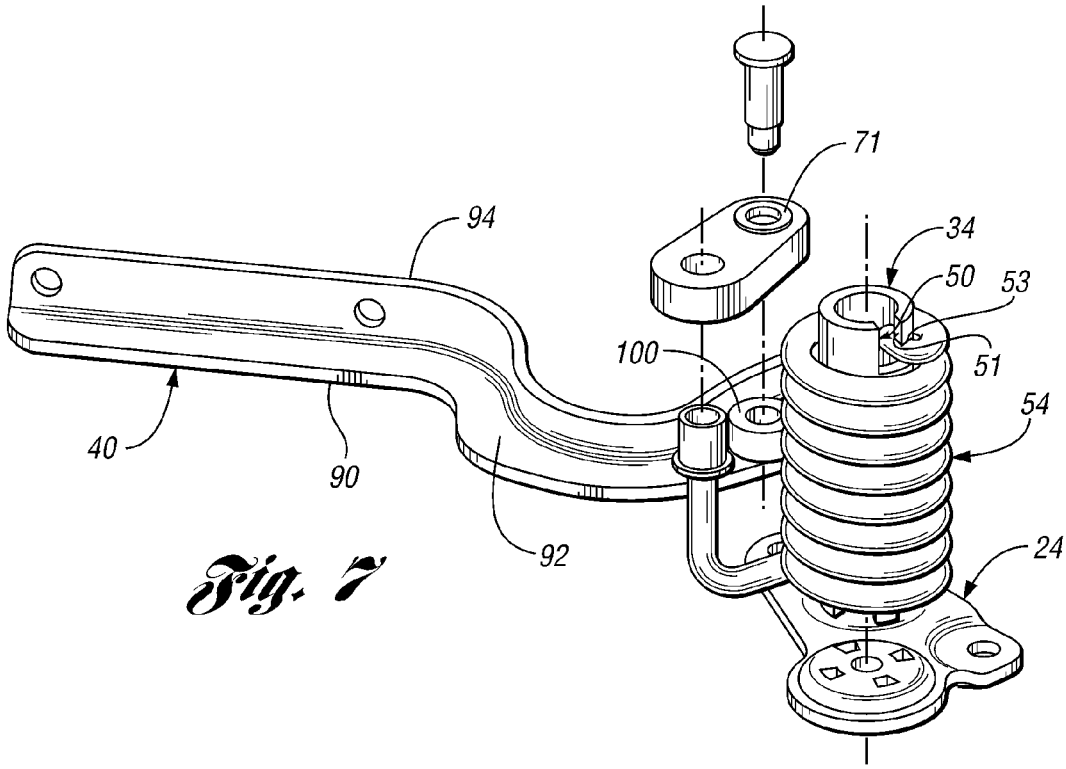
FIG. 7 is an exploded perspective view similar to FIG. 6, but rotated and illustrating another embodiment of a hinge set according to the present invention.
Figure 8:
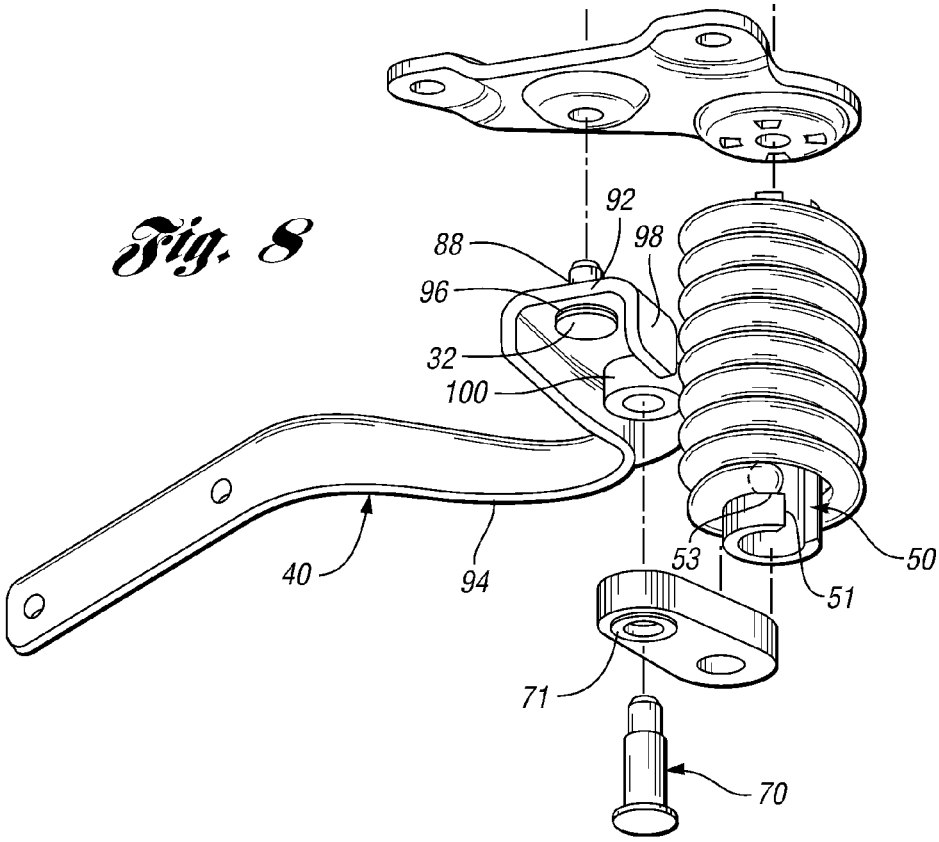
FIG. 8 is a rotated, exploded perspective view showing the hinge set embodiment portions of FIG. 7.

An embodiment that reduces the weight of the hinge set includes a strap 40 made of a stamping 90, shown in FIGS. 7 and 8, that substantially reduces the weight over previously known tubular type straps. Thus, with the configured longitudinal flange 92 and the configured transverse flange 94 joined by a bend, the structure is made more lightweight and compact. For example, the pivot pin 32 may be formed with a substantially shorter shank 88 received in bushing 96 that is carried in an opening in the stamping wall 92. The stamping wall 92 may be reinforced at pivoting end of the strap 40 by a reinforcement wall 98 opposite the stamping wall 94. As a result, a single bushing 96 carries the strap 40 rather than a pair of bushings required for the pair of walls in the tubular strap 40. Nevertheless, reinforcement wall 98 terminates at a position spaced apart from the strap opening receiving a bushing for reception of the link connecting pivot pin 70.

Structural changes and other foundry processes, for example, casting or molding, may be employed without departing from the invention.

As also shown in FIG. 8, pivot pin 70 may also be shorter than pin 32 of FIGS. 1-4 as it is received in a single bushing 71, or adjusted in length to reach through a spacer bushing 100 carried on the pin 70 adjacent to an opening in the wall 92. Of course, other components of the hinge set 22 may also be modified as will be understood by skilled artisans without departing from the invention.

In addition, the number and size of coil loops in the coil portion of the spring, the cross-sectional size or shape of the strand may be modified to adapt the hinge set for use in various vehicle styles and models without requiring reengineering of the hinge mechanism or supplemental props. For example, the force exerted against the hood may be decreased as desired by replacing the coil spring with a spring having a smaller strand diameter, a smaller number of coils, a different diameter of coils, and other factors such as composition of the spring material without requiring reengineering of the linkage formed by the levers 40 and the links 62. Moreover, the linkage may be modified by adjusting one or more of the components such as the link 62 or the lever 40 to adjust the displacement path or force applied against the hood during displacement by the hinge mechanism 20. Moreover, the number of hinge sets employed may be adjusted as desired.

Having thus described embodiments of the present invention, many modifications thereto will become apparent to those skilled in the art without departing from the scope and spirit of the present invention as defined in the appended claims.

What is claimed is:

1. A vehicle body closure hinge for supporting a hood for displacement to and between open and closed positions over an opening defined by peripheral vehicle body structure, comprising at least one hinge set having:

a support plate with a mount for securing said plate to the peripheral vehicle body structure;

a pivot pin carried cantilevered by and fixed relation to said support plate at one end of said pivot pin;

a retainer bar carried cantilevered by and fixed against rotation to said support plate at one end of said retainer bar;

a spring with a helically coiled strand portion, the coil portion receiving said retainer bar within and said retainer bar retaining a first strand end; and a linkage having a lever pivoted on said pivot pin and displaceable by a second strand end of said spring and biasing said lever toward said open position.

2. The hinge as described in claim 1 and further comprising a stop for limiting displacement of said lever at said open position.

3. The hinge as described in claim 2 wherein said stop is an integral part of said at least one hinge set.

4. The hinge as described in claim 3 wherein stop is carried by said lever.

5. The hinge as described in claim 4 wherein said linkage includes a link, and said stop engages a said link at the open position.

6. The hinge as described in claim 1 wherein said second strand end includes an arm extending substantially parallel to said retainer bar.

7. The hinge as described in claim 6 wherein said arm is pivotally received in a link.

8. The hinge as described in claim 7 wherein said link includes a second pivot connection spaced from said arm, said second pivot connection coupling said link for pivoting movement with respect to said lever.

9. A method for packaging a vehicle hood hinge by installing a pair of hinge sets to a peripheral vehicle body structure defining an opening covered by the hood, the method comprising:

mounting a support plate to said peripheral structure;

carrying a pivot pin cantilevered on said support plate;

carrying a retainer bar cantilevered on and fixed relation to said support plate;

biasing a lever pivoted with respect to said plate on said pivot pin with a spring including a helically coiled strand that receives the retainer bar; and retaining a strand end of said spring with said retaining bar.

10. The method as described in claim 9 and comprising limiting displacement of said lever at said open position in at least one set of pair of the hinge sets.

11. The method as described in claim 10 wherein said limiting includes engagement of said lever with respect to an integral part of said at least one set.

12. The method as described in claim 11 wherein said limiting includes engaging a stop on said lever.

13. The method as described in claim 12 wherein said limiting includes engaging a stop on said lever with a link.

14. The method as described in claim 9 wherein said biasing includes linking a second strand end with a link.

15. The method as described in claim 14 wherein said biasing includes pivotally linking a second strand end with said link.

16. The method as described in claim 15 and pivotally connecting said link to said lever.

17. The method as described in claim 14 wherein said linking comprises extending an arm on said second strand end parallel to said retainer.

18. The method as described in claim 9 and wherein said retaining comprises receiving said strand end through a slot in said retainer bar.

* * * * *

UNITED STATES PATENT AND TRADEMARK OFFICE

CERTIFICATE OF CORRECTION

PATENT NO. : 7,546,663 B2
APPLICATION NO. : 11/549295
DATED : June 16, 2009
INVENTOR(S) : Michael J. Duffy It is certified that error appears in the above-identified patent and that said Letters Patent is hereby corrected as shown below:

Column 5, Line 39, Claim 1:

After "cantilevered by"

Delete "and fixed relation to".

Column 6, Line 23, Claim 9:

After "cantilevered on"

Delete "and fixed relation to"

and insert -- and fixed against rotation to --.

Signed and Sealed this

Eighteenth Day of August, 2009

David J. Kappos

David J. Kappos
*Director of the United States Patent and Trademark Office*